US005379099A

United States Patent [19]

Senba et al.

[11] Patent Number: 5,379,099

[45] Date of Patent: Jan. 3, 1995

[54] IMAGE FORMING APPARATUS FORMING OFFSET PREVENTIVE ELECTRIC FIELD ACCORDING TO STATIC ELECTRICITY REMOVAL CURRENT

[75] Inventors: Hisaaki Senba, Yokohama; Hiroshi Matsumoto, Kawasaki; Keisuke Hasegawa, Tokyo, all of Japan

[73] Assignee: Canon Kabushiki Kaisha, Tokyo, Japan

[21] Appl. No.: 73,764

[22] Filed: Jun. 8, 1993

[30] Foreign Application Priority Data

Jun. 17, 1992 [JP] Japan ..... 4-158120

[51] Int. Cl.[6] ..... G03G 15/20

[52] U.S. Cl. ..... 355/284; 355/208; 355/282

[58] Field of Search ..... 355/282, 284, 285, 290, 355/295, 271, 273, 274, 276, 204, 208; 219/216; 118/60

[56] References Cited

U.S. PATENT DOCUMENTS 4,055,380 10/1977 Borostyan ..... 355/273
5,159,394 10/1992 Jinzai ..... 355/290
5,177,549 1/1993 Ohtsuka et al. ..... 355/284

*Primary Examiner*—A. T. Grimley
*Assistant Examiner*—Sandra L. Brasé
*Attorney, Agent, or Firm*—Robin, Blecker Daley & Driscoll

[57] ABSTRACT

Disclosed is an image forming apparatus capable of preventing the offset phenomenon and an electrostatic adhesion jam. The surface of a photosensitive body is uniformly charged by a corona charge device, and then an image of the reflected light from an original is projected on the photosensitive body to obtain an electrostatic latent image. Subsequently, a developer develops the latent image into a visible image with toner. The visible image is, then, electrostatically transferred onto a transfer medium by a charge means. After that, static electricity in the transfer medium is removed by a separation means so as to be separated from the photosensitive body and to be sent to a fixing device.

5 Claims, 7 Drawing Sheets

IMAGE FORMING APPARATUS FORMING OFFSET PREVENTIVE ELECTRIC FIELD ACCORDING TO STATIC ELECTRICITY REMOVAL CURRENT

BACKGROUND OF THE INVENTION

1. Field of the Invention

The present invention relates to an image forming apparatus for forming an image on an image supporter with toner charged with static electricity, transferring the toner image on the image supporter and then fixing the image. More specifically, the present invention relates to an image forming apparatus including a charge removal means for applying electric charge to remove static electricity of a recording medium on which a toner image is transferred, and a means for giving an offset preventive electric field to rotating members for fixing.

2. Related Background Art

An image forming apparatus of the electrophotography system transfers a toner image electrostatically held on a photosensitive member onto a transfer medium, and then removes static electricity of the transfer medium and separates it from the photosensitive member.

As such a separation means for separating the transfer medium from the photosensitive member after the transfer process, a corona discharge device, a static electricity removal needle, and the like is used.

The separation means performs discharge to give electric charge with same pole as that of toner to the transfer medium so that electric charge with reverse pole applied to the transfer medium by a transfer charge device is removed.

As a device for fixing the unfixed toner image, those of the heat roller system consisting of a pair of rotating members are generally used because of high efficiency and so on.

One of the drawbacks of the heat roller system is the offset phenomenon, wherein some of toner adheres to the rotating member which gets in contact therewith during the fixing process and a defective image occurs. Among many factors of this phenomenon, one of the most important factors is the static electricity of the rotating members which acts on toner. Since the fixing roller is generally coated with fluorocarbon resin or the like in order to prevent toner from adhering to the fixing roller, the resin is frictionally electrified with different sign with respect to toner while a sheet goes through the rollers. Thus toner is electrostatically attracted to the fixing roller, or toner is repelled by the pressure roller, thereby causing the offset phenomenon.

Accordingly, a countermeasure has been made, wherein bias voltage is applied to the rotating member for fixing to prevent the offset phenomenon by positively utilizing electrostatic attraction or repulsion.

Application of bias voltage to the rotating member for fixing is a good countermeasure against the offset phenomenon, but an apparatus having a charger for carrying out separation after the transfer process has the following problems.

(1) The offset phenomenon cannot fully be avoided with some kinds of paper or in certain environments.

(2) The sheet sometimes winds around the rotating member and cannot be completely separated therefrom.

The above-mentioned phenomenon (1) is likely to happen when a lot of static electricity of the sheet is removed during the separation process, which is explained as follows. During the transfer process, the sheet and toner are charged with different signs from each other and are electrostatically bound to each other. But, if much static electricity is removed with same sign, little static electricity remains in the sheet, and sometimes the sheet is even charged with same sign as toner. In such a case, even repulsion occurs between toner and the sheet. And, even when a bias which is usually sufficient to prevent the offset phenomenon is applied to the rotating member, the offset phenomenon cannot be sufficiently prevented. The amount of static electricity of the sheet which is removed is easily influenced by the kind of the sheet, environments and the like. For example, under the condition of high humidity, said phenomenon is likely to happen because static electricity removal current tends to be greater.

On the contrary, the above-mentioned phenomenon (2) is likely to happen when little static electricity is removed during the separation process, which can be explained as follows. When little static electricity is removed during separation, a lot of static electricity with different sign with respect to toner remains in the sheet, which is contrary to the case of (1) described above. Accordingly, the offset phenomenon rarely occurs during the fixing process. After the fixing process, however, when a bias with same sign as toner is applied to the rotating member for fixing in order to separate the sheet therefrom, strong electrostatic attraction occurs between the sheet and the rotating member because the sheet is charged a lot with different sign with respect to toner. Therefore, separation failure is likely to happen. Such a phenomenon may happen especially when a static electricity removal needle, and the like which serves as the separation means deteriorates with age and can remove less static electricity.

SUMMARY OF THE INVENTION

An object of the present invention is to provide an image forming apparatus capable of preventing the offset phenomenon even when static electricity removal current varies.

Another object of the present invention is to provide an image forming apparatus capable of preventing an electrostatic adhesion jam to the rotating member for fixing.

A still further object of the present invention is to provide an image forming apparatus comprising:

- an image supporter for holding a toner image;
- a transfer means for electrostatically transferring the toner image on said image supporter onto a recording medium;
- static electricity removal means for applying static electricity removal charge to the recording medium on which the toner image has been transferred;
- rotating members for nipping and conveying the recording medium which holds the toner image and for fixing the toner image;
- offset preventive electric field applying means for applying an offset preventive electric field to said rotating member for fixing; and
- field strength control means for changing strength of offset preventive electric field in correspondence to change in static electricity removal charge applied by said static electricity removal means.

DESCRIPTION OF THE PREFERRED EMBODIMENTS

Figure 1:
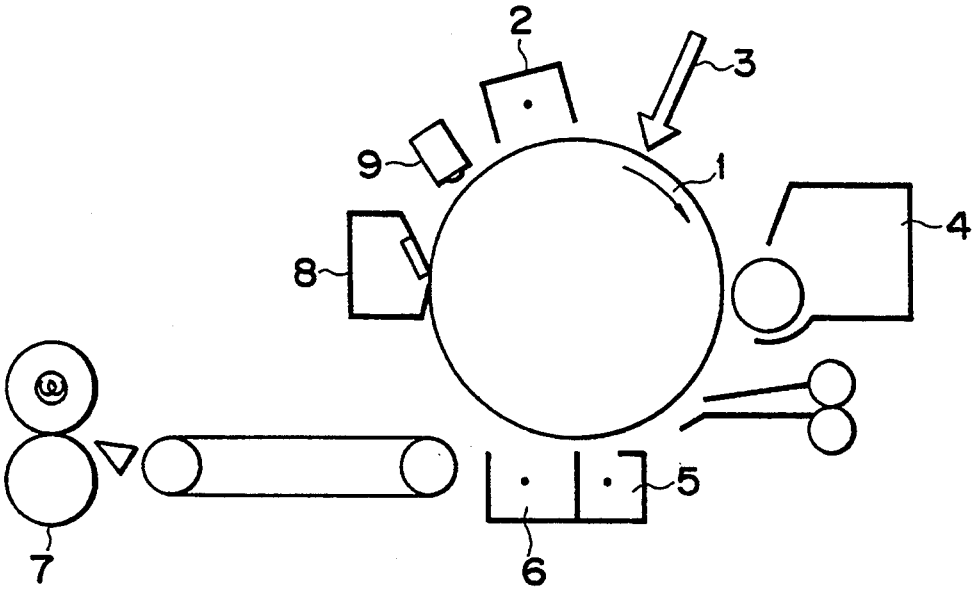
FIG. 1 is a cross-sectional view of the main portions of the first embodiment of the image forming apparatus according to the present invention.
Figure 2:
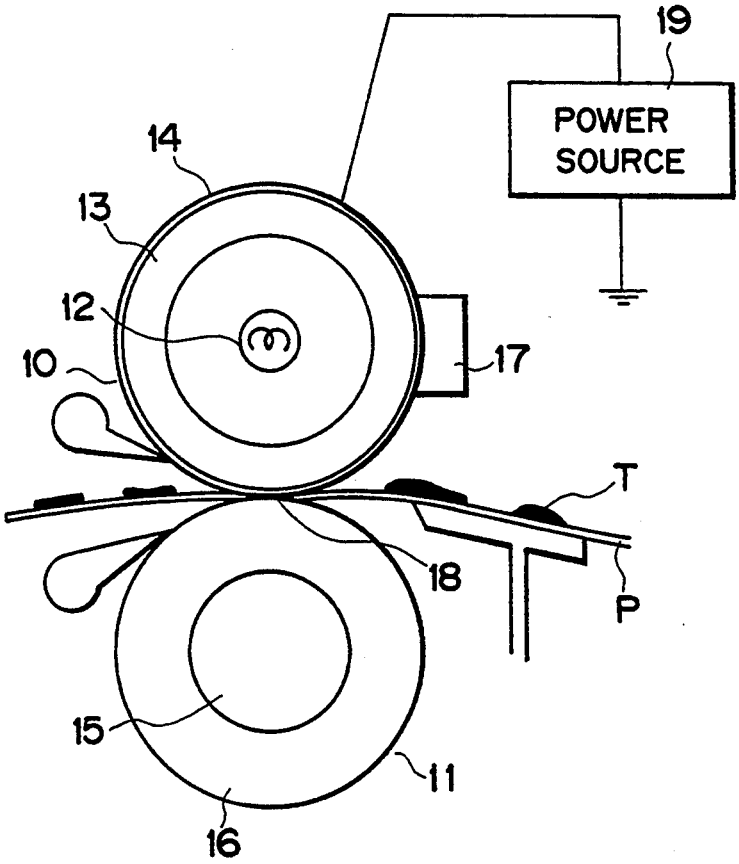
FIG. 2 is an enlarged cross-sectional view of the fixing device in the first embodiment.
Figure 3:
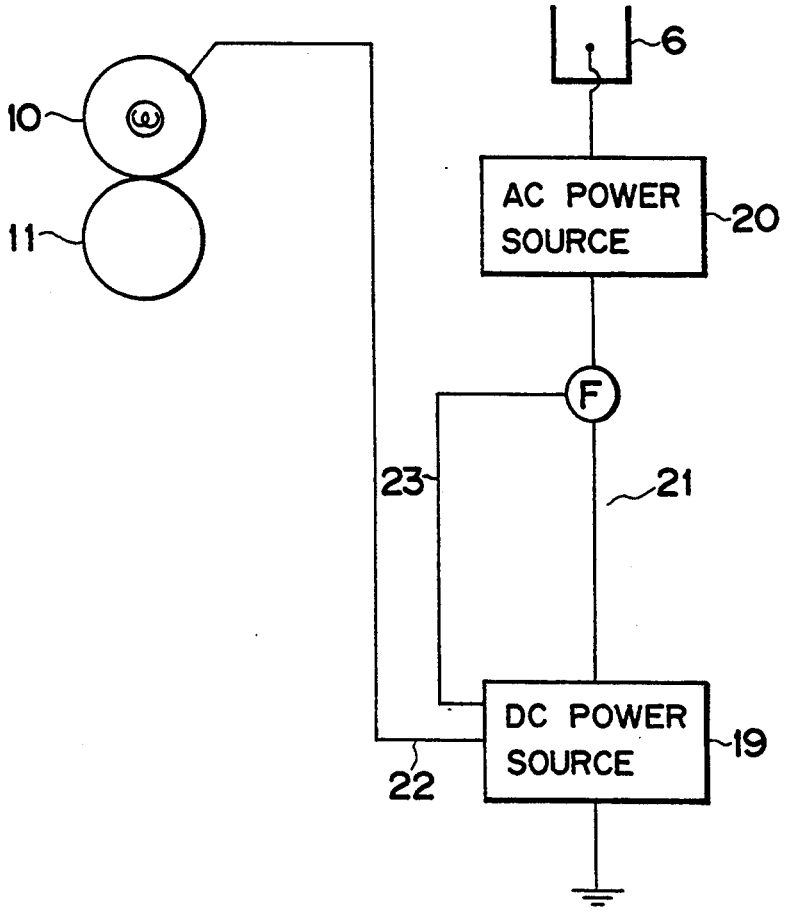
FIG. 3 is a diagram illustrating voltage application from a power source in the first embodiment.
Figure 4:
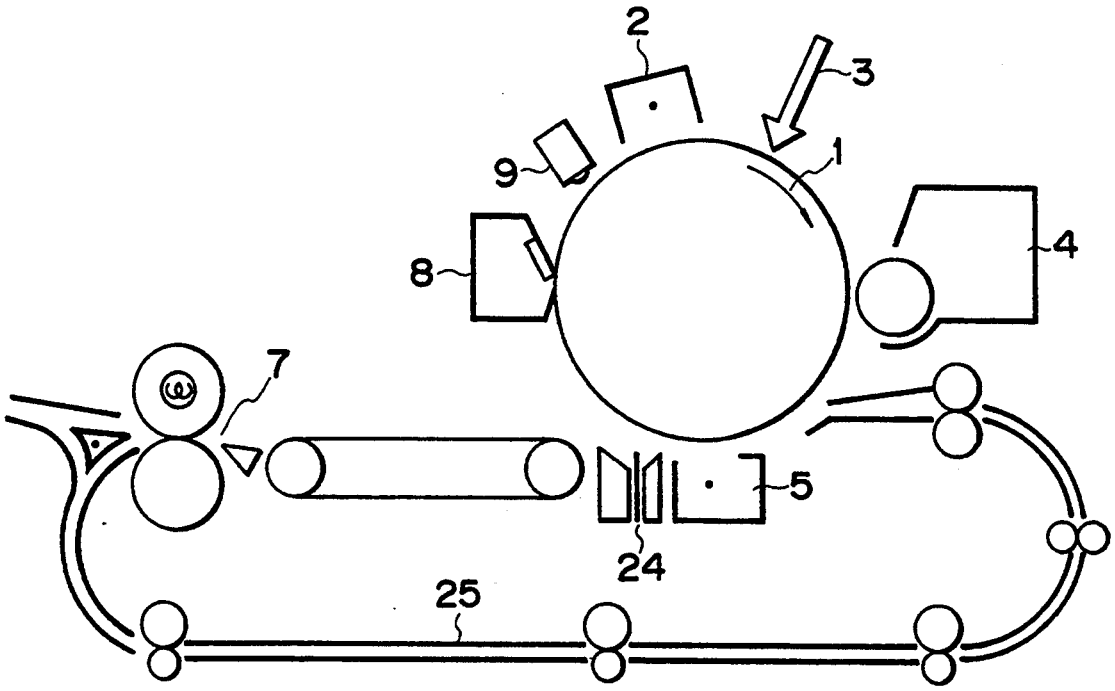
FIG. 4 is a cross-sectional view of the second embodiment of the image forming apparatus according to the present invention.

FIGS. 1 to 3 show the first embodiment according to the present invention.

FIG. 1 is a cross-sectional view of the main portions of an image forming apparatus employing the electrophotography system. The surface of a photosensitive body 1 which rotates as indicated by an arrow is uniformly charged by a corona charge device 2, and then, an image of reflected light from an original (not shown) is projected on the photosensitive body to obtain an electrostatic latent image. Next, a development device develops the latent image into a visible image with colored micro powder (toner) charged with static electricity. Subsequently, the visible image is electrostatically transferred onto a transfer medium such as a sheet and the like by a charge device 5 such as a corona charge device and the like. Afterward, static electricity of the transfer medium is removed by a separation means 6 comprising a corona discharge device in order to separate the recording medium from the photosensitive body and send the recording medium to a fixing device 7.

The toner image on the transfer medium is fixed by heat and pressure in the fixing device 7, and then the transfer medium is ejected out of the apparatus.

On the other hand, after the transfer process, the photosensitive body is cleaned by a cleaning means 8, and unnecessary remaining electric charge is erased by a static electricity removal light source 9 in order to prepare for next image formation. In this system, the charge device 2, the transfer charge device 3 and the separation discharge device 4 are all corona charge devices. The charge devices 2 and 3 are applied with biases with a minus voltage, and the charge device 4 is applied with a bias of DC component superimposed on an AC component. Therefore, the photosensitive body 1 is negatively charged, while toner is positively charged.

FIG. 2 schematically shows the main portions of the fixing device 7. The fixing device in this embodiment is that of heat roller type consisting of a pair of rollers which contain heat sources and rotate while pressure-welding each other. The fixing roller 10, which gets in contact with toner, comprises: a core metal 13 made of a conductive material such as aluminum and the like, which is coated with fluorocarbon resin such as PTF, PFA and the like, or with silicon gum; a heat source 12 such as a halogen lamp and the control element 17 attached to the peripheral surface like contained inside thereof; and a temperature of the fixing roller for controlling the heat source in order to maintain a predetermined fixing temperature which is sufficient to fix toner. The pressure roller 11, which pressure-welds the fixing roller, comprises: a conductive core metal 15; and at least an elastic layer 16 thereon, which is made of silicon gum and the like. The portion of the pressure roller pressure-welding the fixing roller is elastically deformed to constitute a nipper portion 18. The transfer medium P on which the unfixed toner image T is held is nipped and conveyed by the pair of rollers, and the toner image T is fixed on the transfer medium by heat and pressure while passing through the nipper portion. During this fixing process, the above-mentioned offset phenomenon, wherein some of toner adheres to the fixing roller 10 which electrostatically gets in contact therewith, can occur. Accordingly, in order to prevent the phenomenon, a predetermined bias with the same pole as toner (in this case positively); is applied to the fixing roller 10 from a power source 19.

FIG. 3 shows the connections of the power sources for applying biases to a separation discharge device 6 and the fixing roller 10. The power source unit consists of the DC power source 19 and an AC power source 20, wherein the DC power source is provided on the lower potential side (connected with earth). Current for removing static electricity is applied from the DC power source to the separation discharge device 6 through a line 21, the bias is applied from the DC power source to the fixing roller 10 through a line 22, and the DC power source also has a line 23 for feedback from a detected currentness of output of the line 21 to the power source 19.

Since, as described above, the common power source applies voltage to the separation discharge device for applying static electricity removal charge and the means for forming the offset preventive electric field, the bias applied to the fixing roller 10 has voltage which varies in proportion to output current to the separation charge device 6, detected through the feedback line.

Therefore, for example, if discharge from the separation charge device 6 increases in a highly humid environment and a lot of static electricity in the sheet is removed, the bias applied to the fixing roller 10 also increases. Thus, even when excessive static electricity is removed and electrostatic attraction between the sheet and toner is weakened, a repulsion electric field which is sufficient to prevent the offset phenomenon is formed from the fixing roller 10 toward toner. On the contrary, if discharge from the separation discharge device 6 decreases in a low humidity environment, the bias of the fixing roller decreases in proportion to decrease of output current of the separation discharge device. Thus, even if much static electricity with different sign with respect to toner remains in the sheet, electrostatic attraction which acts between the sheet and the fixing roller decreases, and separation failure does not occur.

Second Embodiment

The same members as those in the first embodiment are indicated by the same referential numerals and description thereof is omitted.

Figure 5:
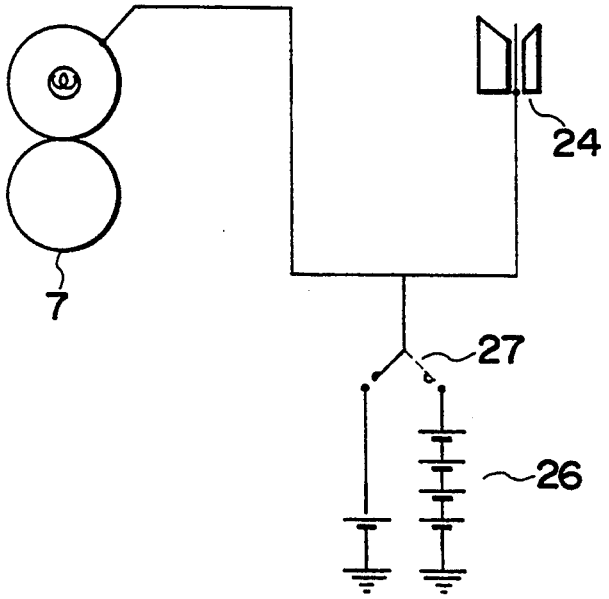
FIG. 5 is a diagram illustrating voltage application from a power source in the second embodiment.

As the separation discharge device, a static electricity removal needle having a sawtoothlike tip is employed, and positive voltage is applied thereto. This embodiment further comprises a circulatory sheet path 25 for double-sided and multiple image formation. FIG. 5 shows relation between the fixing roller 10, the static electricity removal needle, and a power source 26 connected with them. A switching element 27 for switching output modes is connected with the power source 26.

Output of the static electricity removal needle is changed by switching operation of the switching element 27, depending on whether the mode is for one-sided image formation or for two-sided or multiple image formation, in order to properly separate the sheet from the photosensitive body. Further, as shown in the figure, the static electricity removal needle 24 is connected from downstream of the switching element 27 with the fixing roller 10. In such a configuration, the switching element 27 is at first connected to the lower output side as indicated by the solid line in the figure in the one-sided image formation mode, wherein output of the static electricity removal needle 24 is relatively small and small enough to effect separation and the bias is maintained at a low level in correspondence with the small output. In the two-sided/multiple image formation mode, the switching element 27 is switched to the higher output side indicated by the dashed line in the figure. In this way, discharge from the static electricity removal needle 24 is facilitated even if resistance of the sheet increases after it passes through the fixing device 7 and the load between the sheet and the static electricity removal needle becomes large. When the switching element 27 is switched to the higher output side, voltage of the bias of the fixing roller also increases according thereto. Therefore, as in the previous embodiment, fixing bias appropriate to the amount of electric charge in the sheet after the static electricity removal process is applied both in the one-sided image formation mode and in the two-sided/multiple image formation mode, thereby preventing problems such as the offset phenomenon, separation failure of the sheet from the fixing roller, and so on.

Third Embodiment

Figure 6:
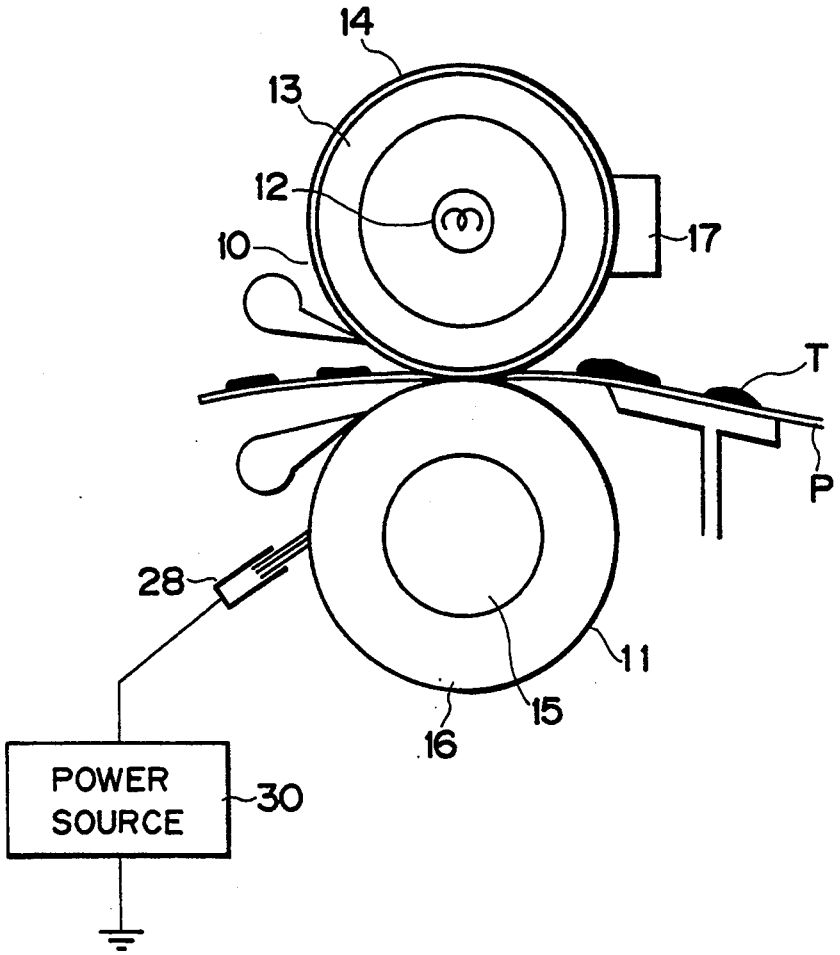
FIG. 6 is an enlarged cross-sectional view of the fixing device in the third embodiment according to the present invention.

FIG. 6 shows the third embodiment of the present invention.

Though, in the above-mentioned first and second embodiments, the bias voltage is applied to the fixing roller which gets in contact with unfixed toner, in this embodiment, potential with reverse pole with respect to toner is applied to the pressure roller. As described before, since the surface of the pressure roller is made of silicon gum and the like, it is often highly negatively charged. Taking a toner which is charged with a negative voltage, for example, the toner and the pressure roller are charged with the same pole in the fixing roller unit, thus electrostatic repulsion occurs therebetween so that the offset of toner to the fixing roller may happen. Accordingly, in order to reduce negative potential in the pressure roller, a charging means 28 for applying positive electric charge. On the other hand, the sheet which has been separated from the photosensitive body and conveyed to the fixing device is charged with different sign with respect to tone (that is, positively charged). Therefore, the highly positively changed charged sheet, urged by adhesive toner which softens at the nipper portion, tends to twine around the fixing roller which is generally negatively charged. Against such a situation, the following construction is employed.

Figure 7:
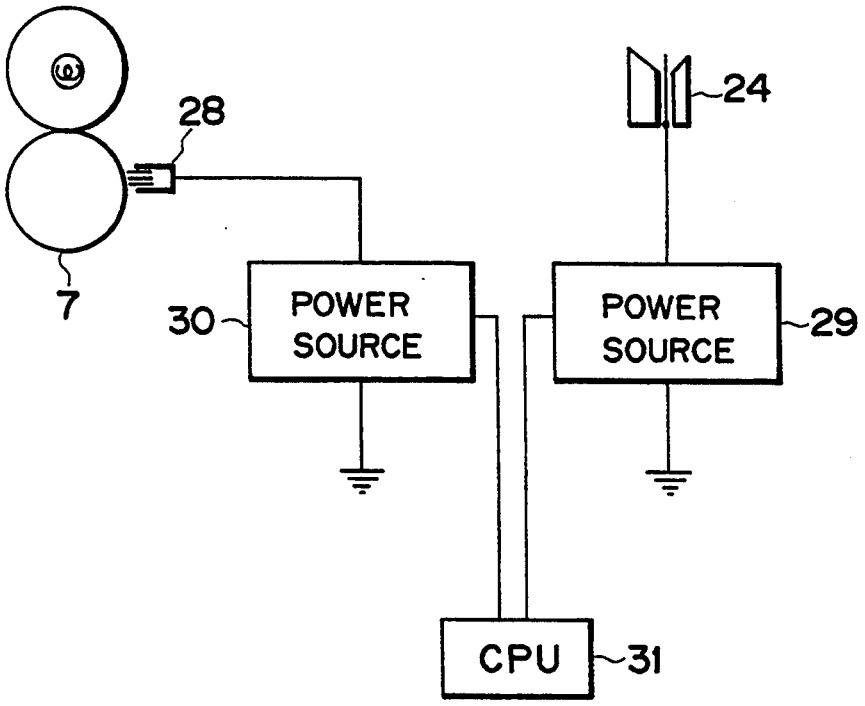
FIG. 7 is a diagram illustrating connections of the fixing device, the static electricity removal needle and the power source in the third embodiment according to the present invention.

As the previous embodiment, the static electricity removal needle 24 serving as the separation discharge device is provided. Further, a brush-like discharge means 28 is provided in the vicinity of the pressure roller. FIG. 7 shows relation of the needle and the discharge means with respect to power sources for applying electric currents thereto. As the power sources, the power source 29 for applying a negative current to the static electricity removal needle connected therewith and the power source for applying positive current to the charging brush 28 connected therewith are provided, wherein their outputs are monitored and controlled by a CPU 31. In said construction, when the electric current through the static electricity removal needle is great, output of the power source 30 is lowered so as to reduce the electric current through the charging brush 28. Therefore, even if the sheet is highly positively charged, electrostatic attraction acts on the sheet both from the fixing roller and from the pressure roller, thereby preventing the sheet from twining around them. On the contrary, if output of the power source 29 is lowered to reduce the electric current through the static electricity removal needle, voltage to be applied to the charging brush is increased, thereby reducing the negative potential in the pressure roller and electrostatic repulsion between the pressure roller and toner. Thus the offset phenomenon of toner to the fixing roller does not occur. As described above, by varying output of the separation means in correspondence to output of the charging means provided on the pressure roller side, the offset phenomenon and the sheet twining can be prevented as in the previous embodiments.

Incidentally, though the corona charge device and the static electricity removal needle have been exemplified as the static electricity removal means in the constructions described above, the present invention can be widely applied to other charging means such as a roller-shaped means, a brush-like charge member, and so on. Similarly, as the means for applying the offset preventive electric field to the fixing and pressure rollers, various kinds of known means can be employed. Furthermore, though the typical heat roller fixing device was exemplified as the fixing device, the present invention, of course, can be applied to other thermal fixing devices, for example, a fixing device using a thin film instead of the fixing roller, and the like.

The above-mentioned preferred embodiments of the present invention do not set any limit to the present invention, but the present invention includes all the variations concerned in the scope of its technical ideas.

What is claimed is:

1. An image forming apparatus comprising: an image supporter for holding a toner image;

transfer means for electrostatically transferring the toner image held on the image supporter onto a recording medium;

static electricity removal means for applying static electricity removal charge to the recording medium on which the toner has been transferred;

a rotating member for nipping and conveying the recording medium holding the toner image and for fixing the toner image;

offset preventive electric field applying means for applying an offset preventive electric field to said rotating member for fixing; and field strength control means for controlling strength of the offset preventive electric field such that the strength becomes high when the static electricity removal charge applied by said static electricity removal means is increased, and becomes low when said static electricity removal charge is decreased.

2. An image forming apparatus according to claim 1, wherein said rotating member for fixing is in contact with the surface of the recording medium on which the unfixed toner image is supported, and said offset preventive electric field applying means applies electric charge with same pole as toner to the 1 rotating member for fixing.

3. An image forming apparatus according to claim 1, wherein said rotating member for fixing is in contact with the opposite surface of the recording medium with respect to the surface on which the unfixed toner image is supported, and said offset preventive electric field applying means applies electric charge with different sign with respect to toner to the rotating member for fixing.

4. An image forming apparatus according to claim 1, wherein said static electricity removal means is provided with a discharge device which is applied with voltage of an AC component superimposed on a DC component, and said field strength control means varies said field strength in correspondence to change in said DC component.

5. An image forming apparatus according to claim 1, further comprising a common power source unit for applying voltage to both of said static electricity removal means and said offset preventive electric field applying means.

* * * * *

UNITED STATES PATENT AND TRADEMARK OFFICE

CERTIFICATE OF CORRECTION

PATENT NO. : 5,379,099

DATED : January 3, 1995

INVENTOR(S) : Hisaaki Senba et al.

It is certified that error appears in the above-identified patent and that said Letters Patent is hereby corrected as shown below:

Col. 1, line 31. After "with" insert -- the -- and after "of" insert -- the --.

Col. 1, line 40. After "of" insert -- the --.

Col. 1, line 48. After "with" insert -- a --.

Col. 2, line 5. After "with" insert -- the --.

Col. 2, line 7. After "with" insert -- the --.

Col. 2, line 14. Delete "the" (second occurrence).

Col. 2, line 23. After "with" insert -- a --.

Col. 2, line 32. After "with" insert -- a --.

Col. 4, line 3. After "the" insert -- like contained inside thereof; and a temperature --.

Col. 4, line 4. Delete "like contained inside".

Col. 4, line 5. Delete "thereof; and a temperature".

Col. 4, line 36. Change "currentness" to -- current --.

Col. 4, line 58. After "with" insert -- a --.

Col. 5, line 3. After "shows" insert -- the --.

Col. 5, line 57. After "charge" insert -- is provided --.

Col. 5, line 59. After "with" insert -- a --.

UNITED STATES PATENT AND TRADEMARK OFFICE

CERTIFICATE OF CORRECTION

PATENT NO. : 5,379,099

DATED : January 3, 1995 Page 2 of 2

INVENTOR(S) : Hisaaki Senba et al.

It is certified that error appears in the above-identified patent and that said Letters Patent is hereby corrected as shown below:

Col. 5, line 60. Change "tone" to -- toner --.

Signed and Sealed this

Eighteenth Day of April, 1995

Bruce Lehman

*Attest:*

BRUCE LEHMAN

*Commissioner of Patents and Trademarks*

*Attesting Officer*